US006756171B2

(12) United States Patent
Roh et al.

(10) Patent No.: US 6,756,171 B2
(45) Date of Patent: Jun. 29, 2004

(54) POLYESTER RESIN AND TONER INCLUDING THE SAME

(75) Inventors: Jae Kyoung Roh, Kyonggi-do (KR); Kye Yune Lee, Kyonggi-do (KR); Tae Woong Lee, Kyonggi-do (KR)

(73) Assignee: SK Chemicals Co., Ltd., Suwon (KR)

( * ) Notice: Subject to any disclaimer, the term of this patent is extended or adjusted under 35 U.S.C. 154(b) by 0 days.

(21) Appl. No.: 10/052,314

(22) Filed: Jan. 15, 2002

(65) Prior Publication Data

US 2003/0064312 A1 Apr. 3, 2003

(30) Foreign Application Priority Data

Jul. 13, 2001 (KR) ..... 10-2001-0042324

(51) Int. Cl.[7] ..... G03G 9/087

(52) U.S. Cl. ..... 430/109.4; 528/272

(58) Field of Search ..... 430/109.4; 528/272

(56) References Cited

U.S. PATENT DOCUMENTS 5,276,127 A * 1/1994 Takyu et al. ..... 430/109.4
6,007,958 A * 12/1999 Ito et al. ..... 430/109.4

* cited by examiner

*Primary Examiner*—Mark A. Chapman
(74) *Attorney, Agent, or Firm*—Pennie & Edmonds LLP

(57) ABSTRACT

The present invention relates to polyester resin for toner used for developing an electrostatic latent image such as a statically charged image in the electrostatic printing process and discloses polyester resin for toner comprising aromatic dicarboxylic acid, trivalent or higher carboxylic acid, aliphatic diol, bisphenol A derivative aromatic diol, and trihydric or higher alcohol, characterized in that the amount of the aromatic diol of bisphenol A derivative having the mole number of ethylene oxide and/or propylene oxide of 2mole is equal to or more than 85weight % in the entire aromatic diol of bisphenol A derivative, and the amount of the aromatic diol of bisphenol A derivative having the mole number of ethylene oxide or propylene oxide of 1mole is less than 0.2weight % in the entire aromatic diol of bisphenol A derivative.

4 Claims, No Drawings

POLYESTER RESIN AND TONER INCLUDING THE SAME

BACKGROUND OF THE INVENTION (a) Field of the Invention

The present invention relates to a polyester resin and a toner including the same, and more particularly, to a polyester resin for preparing a toner useful for developing an electrostatic latent image, such as a statically charged image, in an electrophotographic image forming process.

(b) Description of the Related Art

Generally, an image-forming process, such as the electrophotographic image forming process or an electrostatic printing process, includes the steps of forming an electrostatic latent image, such as a statically charged image or an electro-conductive image corresponding to a recorded image, on a surface of an electrostatic recording member, developing the latent image with charged toner, transferring the toner image on the electrostatic recording member onto a paper or a recording film, and finally fixing the transferred image. The image-forming process has some advantages in that the printed matter can be obtained with high speed, the image formed on the electrostatic recording member is stable, and an image-forming device for such electrophotography process is easy to manipulate. Accordingly, such an image-forming process is widely used in a field of copiers and printers.

In more detail, the image-forming process includes the following steps.

1. an charging process for electrically charging a drum(for example, organic photoconductor drum: OPC) coated with a photoconductive or a photosensitive material,
2. an exposing process for exposing the original image to be copied to a light, and forming an electrostatic latent image on the drum with the light reflected from the original image,
3. a developing process for statically adhering a charged toner onto the drum in a developing machine,
4. a transferring process for sticking a charged paper to the drum, and, electrostatistically transferring the toner from the drum to a paper,
5. a fixing process for fixing the transferred toner with a thermo-pressing roller,
6. a cleaning process for removing the residual toner on the drum,
7. a process for removing the residual charge on the drum by projecting a light.

Generally, the toner including crosslinked polyester as a binder is used in the developing process. Since the image-forming process should be rapidly performed to increase the operating efficiency of the copier or printers, there are various trials to increase the image-forming speed. It is important to increase the toner fixing speed onto the surface of the recording member for rapid image forming. To fix the toner rapidly, the toner should have superior fixing property at low and high temperature, but the toner including conventional polyester does not have such properties.

The low-temperature fixing property of toner can be improved by using a polyester of low softening temperature. However, the toner using polyester of low softening temperature has drawback in its transferability. Therefore, the toner may remain on the surface of the hot roller used for fixing the toner, and the contamination (generally called as "the offset") of the following paper may occur.

As a binder for preventing the offset, the use of crosslinked polyester is generally known. The crosslinked polyester is obtained by reacting an esterified bisphenol A with dicarboxylic acid to produce a linear polyester, and then reacting the produced linear polyester with trivalent or higher carboxylic acid, such as trimellitic acid anhydride. However, the obtained crosslinked polyester has high softening temperature, thus the low-temperature fixing property of the toner is insufficient, and the desired rapid fixing property cannot be obtained. For example, when the same toner is used for the electrophotographic image forming process with a speed of about 50 sheets/minute, the fixing property of the toner is insufficient and the obtained copies does not have the desired toner fixing property.

Polyester having reduced softening temperature for producing a toner having superior offset preventing property and low-temperature fixing property can be obtained by performing the crosslinking reaction so that a long-chain aliphatic hydrocarbon is included into the polyester. However, such polyester has too low glass transition temperature (Tg), and the toner particles are liable to be flocculated while storage, which deteriorates the toner storage property.

In U.S. Pat. Nos. 4,804,622, 4,849,495, and 5,057,596, a binder for toner having improved offset preventing property, improved storage stability, and low and high temperature fixing property is disclosed. The binder includes polyester produced from dicarboxylic acid, diol, and at least one crosslinking agent selected from the group consisting of trivalent or higher carboxylic acid, and trihydric or higher alcohol. Especially, polyester which includes bisphenol A derivative as the diol component is disclosed as the binder. However, in case of an aromatic diol containing the bisphenol A derivative, for example, polyoxypropylene(2,3)-2,2i-bis(4-hydroxyphenyl) propane and polyoxyethylene(1,0)-2,2-bis(4-hydroxyphenyl) propane, the storage stability and low and high temperature fixing property of the toner according to mole number of a repeating unit, that is, ethylene oxide or propylene oxide group is not disclosed. That is, as shown in following chemical equation 1, the mole number w+z of the additional ethylene oxide in polyoxyethylene(1,0)-2,2-bis(4-hydroxyphenyl) propane and the mole number y+z of the additional propylene oxide in polyoxypropylene(2,3)-2,2-bis(4-hydroxyphenyl) propane are not same in every molecule, but has specific distribution, and the storage stability and the low and high temperature fixing property are varied according to the distribution degree.

[Chemical equation 1]

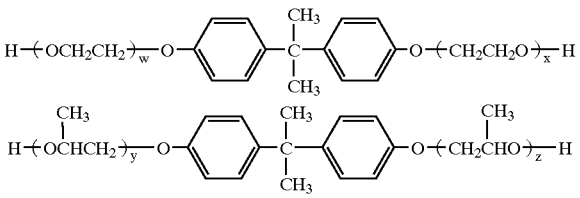

SUMMARY OF THE INVENTION

It is an object of the present invention to provide a polyester resin for producing a toner having improved storage stability, low-temperature and high-temperature fixing properties by optimizing the composition, the amount of each component, and the range of mole number of additional alkylene oxide in aromatic diol of bisphenol A derivative for the production of the polyester. It is another object of the present invention to provide a toner including the same polyester resin.

To achieve these objects, the present invention provides a polyester resin for toner comprising aromatic dicarboxylic acid, trivalent or higher carboxylic acid, aliphatic diol, aromatic diol of bisphenol A derivative, and trihydric or higher alcohol, characterized in that the amount of the aromatic diol of bisphenol A derivative having the mole number of ethylene oxide and/or propylene oxide of 2 mole is equal to or more than 85 weight % in the entire aromatic diol of bisphenol A derivative, and the amount of the aromatic diol of bisphenol A derivative having the mole number of ethylene oxide or propylene oxide of 1 mole is less than 0.2 weight % in the entire aromatic diol of bisphenol A derivative. The present invention further provides a toner including such polyester resin.

Preferably, the polyester resin has 1~25 KOHmg/g of acid value, 130~190° C. of softening temperature, and 50~70° C. of Tg.

DETAILED DESCRIPTION OF THE INVENTION

For a better understanding of the present invention, reference will now be made in detail to the following disclosures. In this specification, the amount of diacid component is represented by mol % in the total diacid components, the amount of trivalent or higher carboxylic acid is represented by mol % to the entire amount of diacid components, and the amount of alcohol component is represented by mol % to the entire amount of diacid components (i.e. mole of alcohol component to the 100 mole of the entire diacid components).

Acid component of the inventive polyester resin for the production of a toner comprises aromatic dicarboxylic acid and trivalent or higher carboxylic acid, and, if necessary, further comprises aliphatic dicarboxylic acid.

The preferable aromatic dicarboxylic acid includes dibasic acid such as terephthalic acid and isophthalic acid, or lower alkyl ester of the dibasic acid. The preferable examples of the dicarboxylic acid include dimethyl terephthalate, dimethyl isophthalate, diethyl terephthalate, diethyl isophthalate, dibutyl terephthalate, and dibutyl isophthalate. The aromatic dicarboxylic acids and their lower alkyl ester can be used independently or in combination.

The aromatic dicarboxylic acid having benzene ring of high hydrophobic property can improve the moisture-proof property of a toner and increase glass transition temperature Tg of the produced resin, which results in the improved storage stability of the toner. Since the terephthalic acid among the aromatic dicarboxylic acid increases toughness and glass transition temperature Tg of the produced resin, and the isophthalic acid increases reactivity, the ratio of terephthalic acid and isophthalic acid can be varied according to the desired property of the polyester.

The examples of the trivalent or higher carboxylic acid for the production of the polyester according to the present invention includes trimellitic acid, pyromellitic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,2,7,8-octanetetracarboxylic acid, and their acid anhydrides. The trivalent or higher carboxylic acid can be used independently or in combination, and increases Tg of the produced resin and makes the resin to have the cohesive property, which results in the improvement of the offset preventing property of the toner.

The examples of the aliphatic dicarboxylic acid includes phthalic acid, sebasic acid, isodecyl succinic acid, maleic acid, fumaric acid, adipic acid, their monomethyl, monoethyl, and dimethylester, and their acid anhydrides. Since such divalent aliphatic carboxylic acid influences on the fixing property and the storage stability of the toner, the same should be properly used according to the kind and the amount of the aromatic dicarboxylic acid and the trivalent or higher carboxylic acid.

In the polyester resin for the production of a toner according to the present invention, the amount of aromatic dicarboxylic acid in the entire diacid is equal to or more than 80 mol %, and preferably equal to or more than 90 mol %, the amount of the trivalent or higher carboxylic acid is 0.5~30 mol %, and preferably 1~25 mol % to the entire diacid (i.e. 1~25 mole per 100 mole of entire diacid). If used, the amount of aliphatic dicarboxylic acid should be used in the amount that does not affect the object of the present invention and according to the required property of resin, and is preferably less than 20 mol % in the entire diacid.

When the amount of the trivalent or higher carboxylic acid is less than 0.5 mol % to the entire diacid, the Tg of produced resin does not sufficiently high and cohesive property of resin is insufficient, which results in the deterioration of the offset preventing property of the toner. When the amount thereof is more than 30 mol %, it is difficult to obtain desired polyester resin due to the gelation of the resin during their production. In addition, when the amount of aromatic dicarboxylic acid is less than 80 mol % in the entire diacid, the storage stability of resin is deteriorated.

Alcohol components used for obtaining polyester resin for toner according to the present invention contains an aromatic diol which is a bisphenol A derivative. Aromatic diol comprising bisphenol A derivative increases Tg of the resin and improves the storage stability and the low and high temperature fixing property of the toner. The examples of bisphenol A derivative aromatic diol used for the production of polyester resin of the present invention includes polyoxyethylene-(2,0)-2,2-bis(4-hydroxyphenyl)propane, polyoxypropylene-(2,0)-2,2-bis(4-hydroxyphenyl)propane, polyoxypropylene-(2,2)-polyoxyethylene-(2,0)-2,2-bis(4-hydroxyphenyl)propane, polyoxyethylene-(2,3)-2,2-bis(4-hydroxyphenyl)propane, polyoxypropylene-(6)-2,2-bis(4-hydroxyphenyl)propane, polyoxypropylene-(2,3)-2,2-bis(4-hydroxyphenyl)propane, polyoxypropylene-(2,4)-2,2-bis(4-hydroxyphenyl)propane, polyoxypropylene-(3,3)-3,3-bis(4-hydroxyphenyl)propane, polyoxyethylene-(3,0)-2,2-bis(4-hydroxyphenyl)propane, and polyoxyethylene-(6)-2,2-bis(4-hydroxyphenyl)propane. The aromatic diols can be used independently or in combination. According to the present invention, the bisphenol A derivative having 2 moles of ethylene oxide and/or propylene oxide is equal to or more than 85 weight % of the entire aromatic diol, and the bisphenol A derivative having 1 mole of ethylene oxide or propylene oxide is less than 0.2 weight % of the entire diol. When the bisphenol A derivative having 2 moles of ethylene oxide and/or propylene oxide is less than 85 weight % of the entire aromatic diol, the Tg of the produced polyester is lowered. In this case, the storage stability of the toner is deteriorated, and the temperature that the offset is occurred is lowered, and the toner image is deteriorated. When the bisphenol A derivative having 1 mole of ethylene oxide or propylene oxide is equal or more than 0.2 weight % of the entire aromatic diol, the polymerization reaction is considerably slowed and the softening temperature and Tg of polyester are lowered, and the toner cannot be properly produced.

According to the present invention, alcohol components include an aliphatic diol. The examples of the useful aliphatic diol include ethylene glycol, diethylene glycol, neopentyl glycol, propylene glycol, and butane diol, and those are used independently or in combination. Such aliphatic diol improves the polycondensation reaction speed. Among the aliphatic diols, ethylene glycol, neopentyl glycol, and butane diol are preferred when considering the fixing property of the toner. Since aliphatic diol makes resin to have the plasticity, and improves the fixing property, but lowers Tg, and deteriorates the storage stability of the toner, it is preferable to use the proper amount of the aliphatic diol according to kinds of machines where toner is used.

Alcohol components used for the production of polyester resin according to the present invention may comprise a trihydric or higher alcohol when necessary. The examples of the trihydric or higher alcohol includes sorbitol, 1,2,3,6-hexatetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Such trihydric or higher alcohol can be used independently or in combination. Such trihydric or higher alcohol increases the Tg of produced resin, makes resin to have cohesive property, and improves the storage stability of the toner.

In polyester resin for toner according to the present invention, the amount of aliphatic diol to the entire diacid is 10~80 mol %, and preferably 15~75 mol %, and the amount of aromatic diol is less than 90 mol %, preferably less than 89.5 mol %, and more preferably 85–10 mol % to the entire diacid considering the low reactivity of the aromatic diol. Further, the amount of the trihydric or higher alcohol is preferably 0.5~50 mol %, and more preferably 1~25 mol % to the entire diacid.

When the amount of trihydric or higher alcohol is less than 0.5 mol %, the storage stability of the toner is deteriorated. When the amount thereof is more than 50 mol %, it is difficult to obtain desired resin due to the gelation of polyester resin during its production. When more than one kind of the trihydric or higher alcohol are used in combination, it is preferable that the total amount of the mixture is within the range described above. When the amount of the aromatic diol is less than 10 mol %, the low-temperature and the high-temperature fixing properties deteriorated, and when the amount thereof is more than 90 mol %, the polymerization speed decreases.

According to the present invention, the acid components and the alcohol components are charged into a reactor and heated to perform the esterification or ester exchange reaction. If necessary, well known and generally used catalyst for the esterification or ester exchange reaction such as titan butoxide, dibutyl tin oxide, magnesium acetate, or manganese acetate may be used. The water or alcohol produced from the reaction can be removed in conventional way. During polymerization reaction, generally known catalyst for polymerization such as titan butoxide, dibutyl tin oxide, tin acetate, zinc acetate, tin disulfide, antimony trioxide, or germanium dioxide may be used.

According to the present invention, the polymerization reaction can successively be performed after the esterification or ester exchange reaction, and in this case, the same is performed while removing diol under vacuum of less than 100 mmHg. The esterification reaction is preferably performed in nitrogen flow, and the polycondensation reaction is preferably performed at low temperature of less than 250° C. and under high vacuum of less than 30 mmHg. The temperature of the polycondensation is more preferably less than 240° C. When the temperature of the polycondensation is more than 250° C., the reaction speed increases, and therefore, it is difficult to obtain desired resin due to the gelation of the polymer.

According to the present invention, the produced polyester resin is used as a main component of binder for the production of toner, and other resin such as styrene resin or styrene-acryl resin can be used in combination with the polyester.

The acid value of the polyester according to the present invention is 1~25 KOHmg/g, and preferably 5~20 KOHmg/g. When the acid value is less than 1 KOHmg/g, developing of the latent image with toner and transferring of the toner are difficult, which deteriorate the image. When the acid value is more than 25 KOHmg/g, the storage stability of the polyester during storage or in the developing machine is deteriorated.

The softening temperature of the polyester of the present invention is 130~190° C., and preferably 140~180° C. When the softening temperature of the polyester is less than 130° C., Tg is lowered to cause the cohesion of toner particles during storage. That is, the storage stability is deteriorated. When the same is more than 190° C., the low-temperature fixing property is deteriorated to cause offset. The Tg of polyester according to the present invention is 50~70° C. When the Tg is less than 50° C., the storage stability of toner produced with such polyester resin is deteriorated, and when the Tg is more than 70° C., the low-temperature fixing property of the toner is deteriorated to cause deterioration of image.

The toner of the present invention contains a binder comprising the above-described polyester resin as a main component, and a coloring agent. The amount of the binder in the toner is preferably 30~95 weight %, and more preferably 35~90 weight %. When the amount of the binder is less than 35 weight %, the offset preventing property of the toner tends to be deteriorated and when the same is more than 95 weight %, electrification stability of the toner tends to be deteriorated. As the coloring agent, the conventional coloring agent generally used for the production of a toner can be used, and the examples of the coloring agent includes carbon black, nigrosine dyes, lamp black, sudan black SM, naval yellow, mineral fast yellow, ritol red, and permanent orange 4R.

In addition, the toner of the present invention may further comprise the additives such as electrification control agent, offset preventing agent, or magnetic powder. Such additives are conventionally used for producing toner. The typical examples of the toner includes electrification control agent such as nigrosine, azine-based dye containing alkyl group, basic dye, monoazo dye and its metal complex, salicylic acid and its metal complex, alkyl salicylic acid and its metal complex, naphtho acid and its metal complex, etc., offset preventing agent such as polyethylene, polypropylene, ethylene-polypropylene copolymer, etc., and magnetic powder such as ferrite, magnetite, etc.

The toner of the present invention is produced by kneading polyester resin according to the present invention as a binder, coloring agent, and additive at the a temperature which is 15~30° C. higher than the softening temperature of the binder with a uniaxial or biaxial extruder or mixer, and pulverizing the same. The average size of the produced toner particle is preferably 5–20 μm, and more preferably 8–15 μm. It is preferable that the minute particle having less than 51 μm of particle size is less than 3 weight % of the toner.

The following examples and comparative examples are provided to illustrate the present invention in more detail, but the present invention is not restricted or limited by the following examples. In the examples, if there is no specific remarks, the amount of diacid component is represented by mol % in the total diacid components, the amount of trivalent or higher carboxylic acid is represented by mol % to the entire amount of diacid components, and the amount of alcohol component is represented by mol % to the entire amount of diacid components. The methods for measuring the respective properties in the examples and the comparative examples are as follows.

(1) Glass Transition Temperature, Tg (°C)

Glass transition temperature is measured with a differential scanning calorimeter (manufactured by TA Instruments) while increasing a sample temperature at 10 C/minute after melting and quenching the sample. The Tg is determined from the mid value of the base lines of an endothermic curve.

(2) Softening Temperature (°C)

The softening temperature(°C) is determined with a flow tester(CFT-500D, manufactured by Shimadzu Laboratories), and is a temperature at the moment that the half of 1.5 g sample flows out from a 1.0Φ×10 mm(height) nozzle under the conditions of 10 kgf of load, and temperature increase of 6° C./minute.

(3) Acid Value (KOHmg/g)

Resin is dissolved in dichloromethane, cooled, and titrated with 0.1N KOH-methyl alcohol solution.

(4) Polymerization Product

In the polycondensation reaction, the case that the product cannot be obtained from the reactor because of the increase of viscosity is defined as "gelation", the case that the polymerization time is more than 500 minutes due to the slow polycondensation reaction is defined as "non-reaction", and other normal reaction is defined as normal.

(5) Minimum Fixing Temperature and Offset Temperature

After coating a white paper with the produced toner, the paper is passed through a heat roller coated with silicon oil with a speed of 200 mm/second. The lowest temperature at which more than 90% of toner is fixed is defined as the minimum fixing temperature. The highest temperature at which more than 90% of toner is fixed is defined as the offset temperature. The minimum fixing temperature and the offset temperature are measured within the range of 50° C. to 220° C.(the heat roller temperature).

(6) Storage Stability 100 g of toner is put into a glass bottle and the bottle is sealed. After 48 hours has passed at 50° C., the cohesion is observed by naked eyes. The cohesion degrees are evaluated as follows.

□: No cohesion and good storage stability

○: Minute cohesion and good storage stability x: Serious cohesion and bad storage stability (7) Toner Image Estimation The image unclearness and the image precision are evaluated by naked eyes when an image is copied on an OHP film or a paper with a black-and-white copier. The copier has a heat roller coated with silicon oil, and a temperature controller, and has a copy speed of 80 pages/minute.

□: No image unclearness and good image precision

○: Little image unclearness and good image precision x: Considerable image unclearness and bad image precision The abbreviations used in the examples and the comparative examples are as follows, and the distribution degrees (weight %) of the mole number of the ethylene or propylene in EBE and PBE are respectively shown in table 1 and 2.

TPA: terephthalic acid

IPA: isophthalic acid

AA: adipic acid

SA: sebasic acid

TMA: trimellitic acid

TMP: trimethylolpropane

EG: ethylene glycol

PBE: polyoxypropylene-(2,3)-2,2-bis(4-hydroxyphenyl) propane

EBE: polyoxyethylene-(2,3)-2,2-bis(4-hydroxyphenyl) propane

TABLE 1

| Mole number | EBE 1 | EBE 2 | EBE 3 | EBE 4 | EBE 5 | EBE 6 | EBE 7 | EBE 8 | EBE 9 |
|---|---|---|---|---|---|---|---|---|---|
| 1 mol | 0.1 | 0.1 | 0.1 | 0.1 | 0.1 | 0.1 | 5.0 | 3.0 | 0.3 |
| 2 mol | 85.0 | 70.0 | 55.0 | 10.0 | 10.0 | 90.0 | 90.0 | 87.0 | 89.9 |
| 3 mol | 9.9 | 24.9 | 40.0 | 75.0 | 20.0 | 9.9 | 5.0 | 10.0 | 9.8 |
| 4 mol | 4.0 | 4.0 | 3.9 | 9.9 | 54.9 | 0.0 | 0.0 | 0.0 | 0.0 |
| 5 mol | 1.0 | 1.0 | 1.0 | 4.0 | 10.0 | 0.0 | 0.0 | 0.0 | 0.0 |
| 6 mol | 0.0 | 0.0 | 0.0 | 1.0 | 4.0 | 0.0 | 0.0 | 0.0 | 0.0 |
| 7 mol | 0.0 | 0.0 | 0.0 | 0.0 | 1.0 | 0.0 | 0.0 | 0.0 | 0.0 |

TABLE 2

| Mole number | PBE 1 | PBE 2 | PBE 3 | PBE 4 | PBE 5 | PBE 6 | PBE 7 | PBE 8 | PBE 9 |
|---|---|---|---|---|---|---|---|---|---|
| 1 mol | 0.1 | 0.1 | 0.1 | 0.1 | 0.1 | 0.1 | 5.0 | 3.0 | 0.3 |
| 2 mol | 85.0 | 71.3 | 57.0 | 10.0 | 10.0 | 91.6 | 91.3 | 86.9 | 90.3 |
| 3 mol | 9.7 | 23.6 | 38.0 | 73.0 | 22.5 | 8.3 | 3.7 | 10.1 | 9.4 |
| 4 mol | 4.2 | 4.0 | 3.9 | 9.8 | 52.4 | 0.0 | 0.0 | 0.0 | 0.0 |
| 5 mol | 1.0 | 1.0 | 1.0 | 6.1 | 10.0 | 0.0 | 0.0 | 0.0 | 0.0 |
| 6 mol | 0.0 | 0.0 | 0.0 | 1.0 | 4.0 | 0.0 | 0.0 | 0.0 | 0.0 |
| 7 mol | 0.0 | 0.0 | 0.0 | 0.0 | 1.0 | 0.0 | 0.0 | 0.0 | 0.0 |

EXAMPLES 1 to 3, COMPARATIVE EXAMPLES 1 TO 3

The polyesters were obtained by esterification and polycondensation with aromatic carboxylic acid, aliphatic carboxylic acid, trivalent carboxylic acid and alcohol, aliphatic diol, and aromatic diol shown in table 3, and with the conditions shown in table 3. The physical properties of the obtained polyesters, and the physical properties and images of the toners produced from the polyesters are investigated and also represented in table 3. According to the conventional method, the toner is produced by mixing 95 weight part of polyester resin, 4 weight part of carbon black, and 1 weigh part of electrification controlling agent, and extruding, cooling, pulverizing, and classifying the mixture to obtain the toner having average particle size of 10~13 μm.

TABLE 3

| | Example 1 | Example 2 | Comparative example 1 | Example 3 | Comparative example 2 | Comparative example 3 |
|---|---|---|---|---|---|---|
| TPA | 75 | 93 | 60 | 70 | 75 | 75 |
| IPA | 25 | 0 | 15 | 20 | 25 | 25 |
| TMA | 3 | 0.5 | 3 | 28 | 0.2 | 33 |
| AA | 0 | 7 | 25 | 0 | 0 | 0 |
| SA | 0 | 0 | 0 | 10 | 0 | 0 |
| EG | 44 | 44 | 44 | 44 | 44 | 44 |
| EBE 1 | 18 | 18 | 18 | 18 | 18 | 18 |
| PBE 1 | 18 | 18 | 18 | 18 | 18 | 18 |
| TMP | 20 | 20 | 14 | 20 | 14 | 14 |
| Polymerization Time (minute) | 155 | 175 | 163 | 149 | 201 | 45 |
| Polymerization Product | Normal | Normal | Normal | Normal | Normal | Gelation |
| Softening temperature (° C.) | 179 | 150 | 162 | 189 | 172 | 225 |
| Tg (° C.) | 66 | 57 | 48 | 69 | 47 | 92 |
| Acid value (KOH mg/g) | 8 | 2 | 2 | 18 | 6 | — |
| Minimum fixing temperature (° C.) | 125 | 138 | 120 | 127 | 126 | — |
| Offset temperature (° C.) | 220 | 216 | 215 | 220 | 187 | — |
| Storage stability | □ | □ | x | □ | x | □ |
| Toner image | □ | □ | ○ | □ | x | — |

As shown in table 3, polyester resin according to the examples 1 and 2 shows the results that polymerization time is good and the softening temperature, Tg, and the acid value are proper to produce toner. In addition, the toner produced with the same polyester resin has good low and high temperature fixing property, the storage stability, and the image condition. Further, even when trivalent carboxylic acid of 0.5~30 mol % to the entire amount of diacid is used, polyester and toner have good physical properties.

On the contrary, when aromatic dicarboxylic acid is less than 80 mol % of the entire diacid (comparative example 1), the Tg is lowered to deteriorate the storage stability of the toner, and therefore, the toner supply to a drum in a developing machine is not smooth to cause minute unclearness of image. When aromatic dicarboxylic acid is less than 0.5 mol % in the entire diacid (comparative example 2), the Tg is lowered to deteriorate the storage stability of the toner, and therefore, the toner supply to a drum in a developing machine is not smooth to cause considerable unclearness of image and inferior image precision. Further, when aromatic dicarboxylic acid is more than 30 mol % in the entire diacid (comparative example 3), it is impossible to obtain polyester from the reactor due to the gelation in the polycondensation reaction. In addition, it is impossible to measure the acid value of the polyester since polyester is not melted by dichloromethane due to the gelation, and it is also impossible to produce toner due to its high softening temperature.

EXAMPLES 4 to 6 AND COMPARATIVE EXAMPLES 4 TO 8

The polyesters were obtained by esterification and polycondensation with aromatic carboxylic acid, aliphatic carboxylic acid, trivalent carboxylic acid and alcohol, aliphatic diol, and aromatic diol shown in table 4, and with the conditions shown in table 4. The physical properties of the obtained polyesters, and the physical properties and images of the toners produced from the polyesters are investigated and also represented in table 4. The toner is produced according to the same method described in Example 1.

TABLE 4

| | Example 4 | Example 5 | Comparative example 4 | Comparative example 5 | Example 6 | Comparative example 6 | Comparative example 7 | Comparative example 8 |
|---|---|---|---|---|---|---|---|---|
| TPA | 60 | 62 | 75 | 75 | 40 | 75 | 75 | 75 |
| IPA | 40 | 30 | 25 | 25 | 55 | 25 | 25 | 25 |
| TMA | 2 | 3 | 3 | 3 | 3 | 3 | 3 | 3 |
| AA | 0 | 0 | 0 | 0 | 5 | 0 | 0 | 0 |
| SA | 0 | 8 | 0 | 0 | 0 | 0 | 0 | 0 |
| EG | 16 | 73 | 8 | 83 | 16 | 16 | 23 | 30 |
| EBE 1 | 28 | 10 | 36 | 6 | 41 | 50 | 49 | 7 |
| PBE 1 | 42 | 8 | 42 | 6 | 41 | 42 | 27 | 7 |
| TMP | 14 | 20 | 14 | 4 | 3 | 14 | 0.4 | 56 |
| Polymerization Time (minute) | 158 | 165 | 560 | 185 | 189 | 690 | 235 | 35 |
| Polymerization Product | Normal | Normal | Non-reaction | Normal | Normal | Non-reaction | Normal | Gelation |

TABLE 4-continued

| | Example 4 | Example 5 | Comparative example 4 | Comparative example 5 | Example 6 | Comparative example 6 | Comparative example 7 | Comparative example 8 |
|---|---|---|---|---|---|---|---|---|
| Softening temperature (° C.) | 162 | 175 | 87 | 171 | 134 | 95 | | 231 |
| Tg (° C.) | 61 | 64 | 37 | 46 | 52 | 40 | 47 | 91 |
| Acid value (KOH mg/g) | 11 | 4 | 29 | 7 | 5 | 26 | 3 | — |
| Minimum fixing temperature (° C.) | 123 | 127 | — | 126 | 121 | — | 118 | — |
| Offset temperature (° C.) | 214 | 218 | — | 217 | 206 | — | 175 | — |
| Storage stability | □ | □ | x | x | □ | x | x | □ |
| Toner image | □ | □ | — | ○ | □ | — | x | — |

As shown in table 4, when aliphatic diol is 10~80 mol % to the entire diacid (examples 4 and 5), the produced polyester and toner shows good physical properties. When aliphatic diol is below 10 mol % to the entire diacid (comparative example 4), the amount of aromatic diol having relatively slow reaction speed increases, and the reaction speed is considerably slow, and it is impossible to produce toner due to the low softening temperature and Tg. In addition, when aliphatic diol is more than 80 mol % to the entire diacid (comparative example 5), the fixing property of the produced toner is fine, but the Tg is lowered to deteriorate the storage stability.

Further, bisphenol A derivative aromatic diol is less than 90 mol % to the entire diacid (example 6), the produced polyester and toner shows fine physical properties, but when bisphenol A derivative aromatic diol is over 90 mol % to the entire diacid (comparative example 6), the amount of aromatic diol having relatively slow reaction speed increases, and the reaction speed is considerably slow, and it is impossible to produce toner due to the low softening temperature and Tg. When the amount of trihydric alcohol is below 0.5 mol % to the entire diacid (comparative example 7), the Tg is lowered to deteriorate the storage stability of the toner, and the minimum fixing temperature and the offset temperature are lowered to deteriorate the fixing property of the toner. When the amount of the trihydric alcohol is more than 50 mol % to the entire diacid (comparative example 8), it is impossible to obtain polyester from the reactor due to the gelation during the polycondensation reaction. In addition, it is impossible to measure the acid value of the polyester since the polyester is not melted by dichloromethane due to the gelation, and it is also impossible to produce toner due to its high softening temperature.

EXAMPLES 7 AND 8 AND COMPARATIVE EXAMPLES 9 TO 15

Polyester is produced with the same compositions, and the same esterification and polycondensation conditions as that of the example 1 except that bisphenol A derivative, EBE and PBE having different mole number of ethylene oxide or propylene oxide is used. The toner is produced according to the method of example 1. The physical properties of the produced polyester and toner are investigated and represented in table 5.

TABLE 5

| | Example 7 | Comparative example 9 | Comparative example 10 | Comparative example 11 | Comparative example 12 | Example 8 | Comparative example 13 | Comparative example 14 | Comparative example 15 |
|---|---|---|---|---|---|---|---|---|---|
| EBE | EBE 1 | EBE 2 | EBE 3 | EBE 4 | EBE 5 | EBE 6 | EBE 7 | EBE 8 | EBE 9 |
| PBE | PBE 1 | PBE 1 | PBE 1 | PBE 1 | PBE 1 | PBE 1 | PBE 1 | PBE 1 | PBE 1 |
| Polymerization Time (minute) | 155 | 280 | 390 | 450 | 495 | 153 | 725 | 650 | 530 |
| Polymerization Product | Normal | Normal | Normal | Normal | Normal | Normal | Non-reaction | Non-reaction | Non-reaction |
| Softening temperature (° C.) | 179 | 139 | 129 | 118 | 116 | 178 | 88 | 92 | 112 |
| Tg (° C.) | 66 | 49 | 49 | 45 | 41 | 65 | 32 | 40 | 42 |
| Acid value (KOH mg/g) | 8 | 10 | 12 | 7 | 14 | 6 | 34 | 24 | 22 |
| Minimum fixing temperature (° C.) | 125 | 118 | 110 | 105 | 103 | 123 | — | — | — |

TABLE 5-continued

| | Example 7 | Comparative example 9 | Comparative example 10 | Comparative example 11 | Comparative example 12 | Example 8 | Comparative example 13 | Comparative example 14 | Comparative example 15 |
|---|---|---|---|---|---|---|---|---|---|
| Offset temperature (° C.) | 220 | 190 | 182 | 180 | 169 | 220 | — | — | — |
| Storage stability | □ | ○ | ○ | ○ | x | □ | x | x | x |
| Toner image | □ | x | x | x | x | □ | x | — | — |

As shown in table 5, when EBE and PBE having more than 85 weight % of 2 mole additive and less than 0.2 weight % of 1 mole additive are used (examples 7 and 8), the physical properties of polyester and the fixing property, the storage stability, and the image of toner are all satisfactory. On the contrary, when 2 mole additive of EBE is below 85 weight % though 2 mole additive of PBE is more than 85 weight % (comparative examples 9 to 12), the Tg of polyester is low to deteriorate the storage stability of toner and the offset temperature is also low to deteriorate the image condition. In addition, when 1 mole additive of EBE is over 0.2 weight % though 2 mole additive of PBE is more than 85 weight % and 2 mole additive of EBE is more than 85 weight % (comparative examples 13 to 15), the polymerization speed is considerably lowered and the softening temperature and the Tg of polyester are lowered. Accordingly, the storage stability and the image condition of toner are deteriorated.

EXAMPLES 9 AND 10 AND COMPARATIVE EXAMPLES 16 TO 22

Polyester is produced with the same compositions, and the same esterification and polycondensation conditions as that of the example 1 except that bisphenol A derivative, EBE and PBE having different mole number of ethylene oxide or propylene oxide is used. The toner is produced according to the method of example 1. The physical properties of the produced polyester and toner are investigated and represented in table 6.

TABLE 6

| | Example 9 | Comparative example 16 | Comparative example 17 | Comparative example 18 | Comparative example 19 | Example 10 | Comparative example 20 | Comparative example 21 | Comparative example 22 |
|---|---|---|---|---|---|---|---|---|---|
| EBE | EBE 1 | EBE 1 | EBE 1 | EBE 1 | EBE 1 | EBE 1 | EBE 1 | EBE 1 | EBE 1 |
| PBE | PBE 1 | PBE 2 | PBE 3 | PBE 4 | PBE 5 | PBE 6 | PBE 7 | PBE 8 | PBE 9 |
| Polymerization Time (minute) | 157 | 271 | 288 | 452 | 492 | 155 | 730 | 655 | 535 |
| Polymerization Product | Normal | Normal | Normal | Normal | Normal | Normal | Non-reaction | Non-reaction | Non-reaction |
| Softening temperature (° C.) | 176 | 141 | 127 | 120 | 118 | 175 | 90 | 96 | 115 |
| Tg (° C.) | 66 | 49 | 48 | 46 | 43 | 64 | 35 | 44 | 46 |
| Acid value (KOH mg/g) | 8 | 9 | 11 | 7 | 13 | 5 | 33 | 20 | 17 |
| Minimum fixing temperature (° C.) | 123 | 117 | 113 | 107 | 105 | 122 | — | — | — |
| Offset temperature (° C.) | 220 | 193 | 186 | 181 | 171 | 220 | — | — | — |
| Storage stability | □ | ○ | ○ | ○ | x | □ | x | x | x |
| Toner image | □ | x | x | x | x | □ | x | — | — |

As shown in table 6, when EBE and PBE both having more than 85 weight % of 2 mole additive and less than 0.2 weight % of 1 mole additive are used (examples 9 and 10), the physical properties of polyester and the fixing property, the storage stability, and the image of toner are all satisfactory. On the contrary, when 2 mole additive of PBE is below 85 weight % though 2 mole additive of EBE is more than 85 weight % (comparative examples 16 to 19), the Tg of polyester is low to deteriorate the storage stability of toner and the offset temperature is also low to deteriorate the image condition. In addition, when 1 mole additive of PBE is over 0.2 weight % though 2 mole additive of EBE is more than 85 weight % and 2 mole additive of PBE is more than 85 weight % (comparative examples 20 to 22), the polymerization speed is considerably lowered and the softening temperature and the Tg of polyester are lowered. Accordingly, the storage stability and the image condition of toner are deteriorated.

As described above, according to the polyester resin for the production of toner according to the present invention, the polymerization of polyester is smoothly processed by regulating the amount and the composition of each component and the range of additional mole number of alkylene oxide included in the aromatic diol of bisphenol A derivative. In addition, according to the present invention, the Tg and cohesion property of produced polyester are high and toner produced by such polyester resin has superior storage stability, offset preventing property, and low and high temperature fixing properties.

While the present invention has been described in detail with reference to the preferred examples, those skilled in the art will appreciate that various modifications and substitutions can be made thereto without departing from the spirit and scope of the present invention as set forth in the appended claims.

What is claimed is:

1. Polyester resin for the production of toner comprising aromatic dicarboxylic acid, trivalent or higher carboxylic acid, aliphatic diol, bisphenol A derivative aromatic diol, and trihydric or higher alcohol, wherein the amount of the bisphenol A derivative aromatic diol having the mole number of ethylene oxide and/or propylene oxide of 2 mole is equal to or more than 85 weight % of the entire bisphenol A derivative aromatic diol, the amount of the bisphenol A derivative aromatic diol having the mole number of ethylene oxide or propylene oxide of 1 mole is less than 0.2 weight % of the entire bisphenol A derivative aromatic diol, the amount of the aromatic dicarboxylic acid is more than 80 mol % of the entire diacid, the amount of the trivalent or higher carboxylic acid is 0.5–30 mol % of the entire diacid, the amount of the aliphatic diol is 10–80 mol % of the entire diacid, the amount of the aromatic diol is less than 90 mol % of the entire diacid, and the amount of the trihydric or higher alcohol is 0.5–50 mol % of the entire diacid.

2. Polyester resin according to claim 1 further comprising less than 20 mol % of aliphatic dicarboxylic acid to the entire diacid.

3. Polyester resin according to claim 1, wherein the acid value of the polyester is 1–25 KOH mg/g, the softening temperature thereof is 130–190° C., and the Tg thereof is 50–70° C.

4. Toner comprising polyester resin according to claim 1.

* * * * *